United States Patent [19]

Anderson

[11] Patent Number: 5,005,667

[45] Date of Patent: Apr. 9, 1991

[54] EXTENSIBLE AND RETRACTABLE STEP ASSEMBLY

[76] Inventor: Eddy Anderson, 1681 NE. 172nd St., North Miami Beach, Fla. 33162

[21] Appl. No.: 496,936

[22] Filed: Mar. 21, 1990

[51] Int. Cl.[5] ..... A47B 77/10; A47B 96/00

[52] U.S. Cl. ..... 182/15; 182/88; 182/35

[58] Field of Search ..... 182/88, 15, 35

[56] References Cited

U.S. PATENT DOCUMENTS

| | | | |
|---|---|---|---|
| 1,681,879 | 8/1928 | Putnam | 182/33.5 |
| 2,314,478 | 3/1943 | Brower | 182/15 |
| 2,881,040 | 4/1959 | Hartridge | 312/235 |
| 3,311,190 | 3/1967 | Naumann | 182/129 |
| 3,481,429 | 12/1969 | Gaede | 182/88 |

*Primary Examiner*—Reinaldo P. Machado
*Attorney, Agent, or Firm*—Oltman and Flynn

[57] ABSTRACT

An extensible and retractable step assembly for a floor cabinet having an open rectangular base slidably mounted in an interior space at the bottom of the cabinet immediately above the floor and selectively positionable in the cabinet or in front of the cabinet, a step which fits inside this base, and slidable pivoted linkages connecting the step to the base and permitting the step to be raised up from the base when the base is extended in front of the cabinet.

6 Claims, 3 Drawing Sheets

FIG. 8
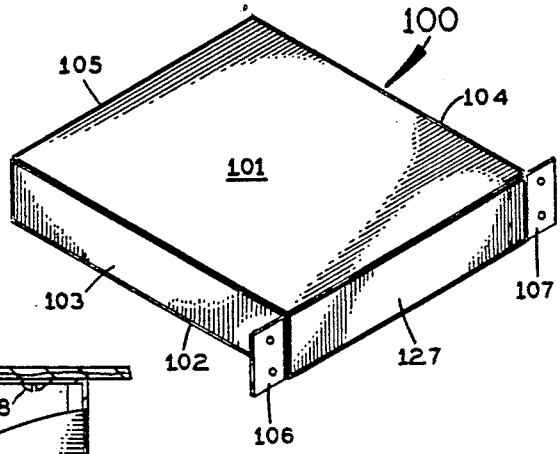
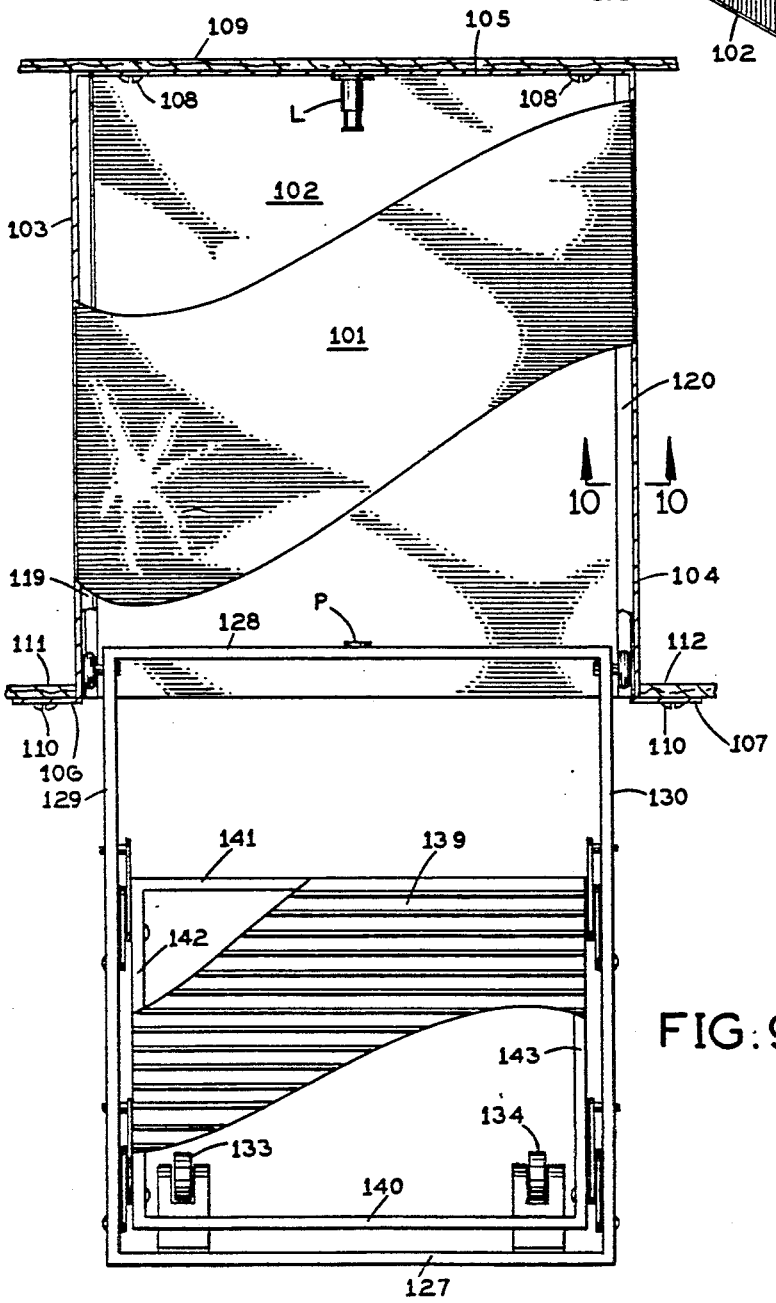
FIG. 9
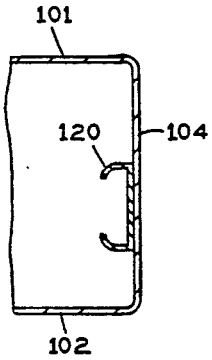
FIG. 10

EXTENSIBLE AND RETRACTABLE STEP ASSEMBLY

This invention relates to an extensible and retractable step assembly for a cabinet standing on a floor.

SUMMARY OF THE INVENTION

Typically, a kitchen has one or more lower cabinets which stand on the floor and one or more wall-mounted cabinets spaced above the lower cabinets. Some people while standing on the floor cannot conveniently reach the top shelf of the wall cabinet.

The present invention relates to a novel step assembly which normally is positioned inside the lower end of the floor cabinet and can be extended to a position engaging the floor in front of the lower cabinet and presenting a raised step on which a person may stand. Preferably, the step assembly of this invention has an open rectangular base with floor-engaging rollers near the front and guide rollers and sliding pivoted linkages on its opposite sides, fixed guide rails outside the base on opposite sides which receive the guide rollers on the base, and a step connected to the linkages for adjustment between a retracted, lowered position inside the base and a raised position above the base.

A principal object of this invention is to provide a novel extensible and retractable step assembly for a floor cabinet.

Further objects and advantages of this invention will be apparent from the following detailed description of two presently preferred embodiments which are illustrated schematically in the accompanying drawings.

DESCRIPTION OF THE DRAWINGS

FIG. 8 is a perspective view of a step assembly kit in accordance with a second embodiment of this invention;

FIG. 9 is a horizontal section through a floor cabinet equipped with this kit, with the step pulled out; and FIG. 10 is a fragmentary vertical section taken along the line 10—10 in FIG. 9 through one of the guide rails of the step assembly. Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
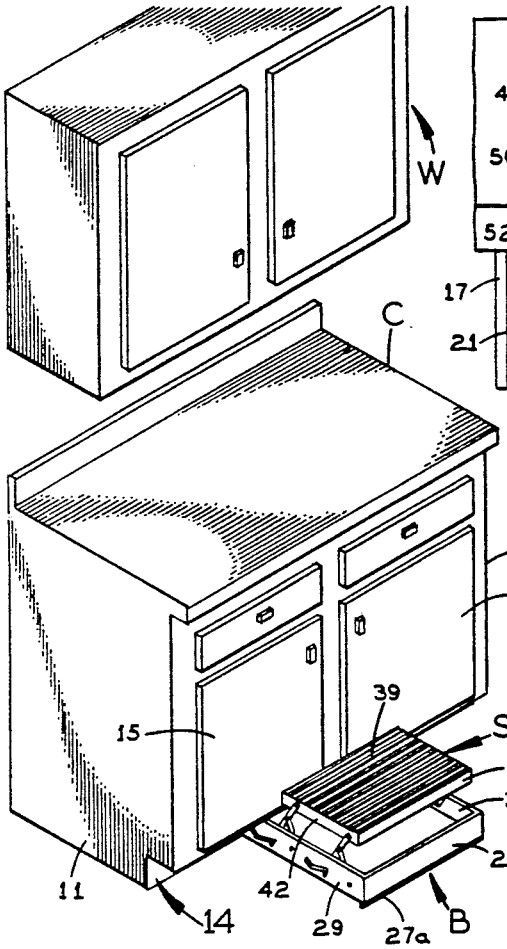
FIG. 1 is a perspective view of a floor cabinet and a wall cabinet in a kitchen, with the floor cabinet being equipped with a step assembly according to a first embodiment of the present invention, shown in its extended position.
Figure 3:
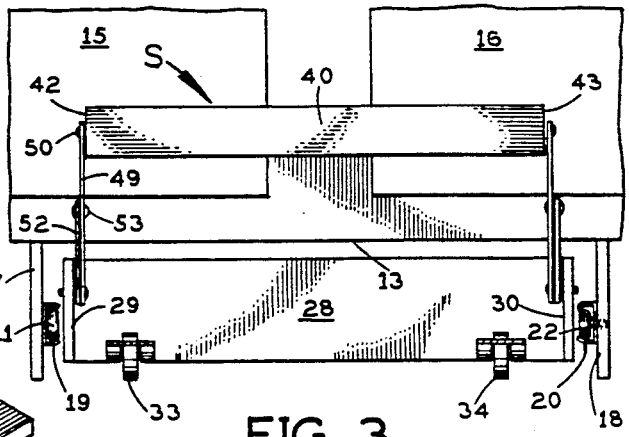
FIG. 3 is a view taken along the line 3—3 in FIG. 2 and showing the step assembly partly in front elevation and partly in section.

Referring first to FIG. 1, a typical kitchen has one or more wall cabinets W of known design spaced above floor cabinets C, also of known design. Typically, the floor cabinet C has opposite vertical side walls 11 and 12 resting on the floor F and an internal bottom wall 13 (FIG. 2) extending horizontally between the sides walls a few inches above the floor. At the front the floor cabinet is recessed along the bottom, as shown at 14 in FIGS. 1 and 2, providing a "kick space" to accommodate the front part of the feet of a person standing in front of the cabinet and facing the wall cabinet W. In the embodiment shown, the floor cabinet C has a pair of doors 15 and 16, each hinged along its outer vertical edge. As shown in FIG. 3, the floor cabinet has internal legs 17 and 18 extending down from its internal bottom wall 13 to the floor F and respectively located part-way across the front doors 15 and 16. Legs 17 and 18 and the internal bottom wall 13 form a hollow interior space at the bottom of cabinet C directly above the floor F.

In broad outline (FIG. 1), the step assembly of the present invention comprises an open rectangular base B, a step S, a pair of first guide members 19 and 20 (FIG. 3) affixed to the inside of the floor cabinet legs 17 and 18, respectively, and second guide members 21 and 22 supported from opposite sides of the base B and received in the first guide members 19 and 20, respectively.

Figure 6:
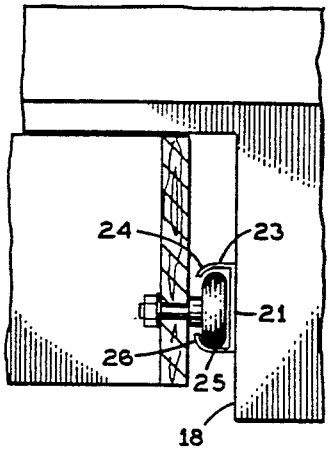
FIG. 6 is a fragmentary vertical section taken along the line 6—6 in FIG. 5 at the guide roller on one side of the base of the step assembly.
Figure 7:
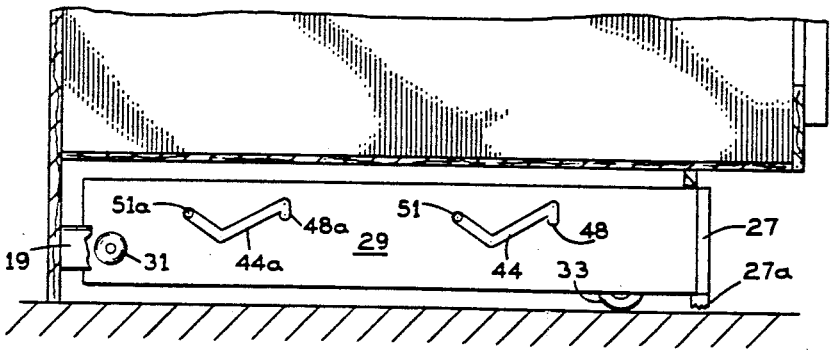
FIG. 7 is a view like FIG. 4 but with the step assembly retracted beneath the internal bottom wall of the floor cabinet.

As shown in FIG. 6, the first guide member 20 on one side of the hollow interior space at the bottom of the cabinet is a rigid channel with a flat back wall 21 attached to the floor channel wall 18 by screws 22 (FIG. 2), a top wall 23 extending horizontally from the top edge of the back wall and terminating in a downwardly curved lip 24, and a bottom wall 25 extending horizontally from the bottom edge of the back wall and terminating in an upwardly curved lip 26.

The first guide member 19 on the opposite internal leg 17 of the cabinet is a mirror image of guide member 20.

Figure 5:
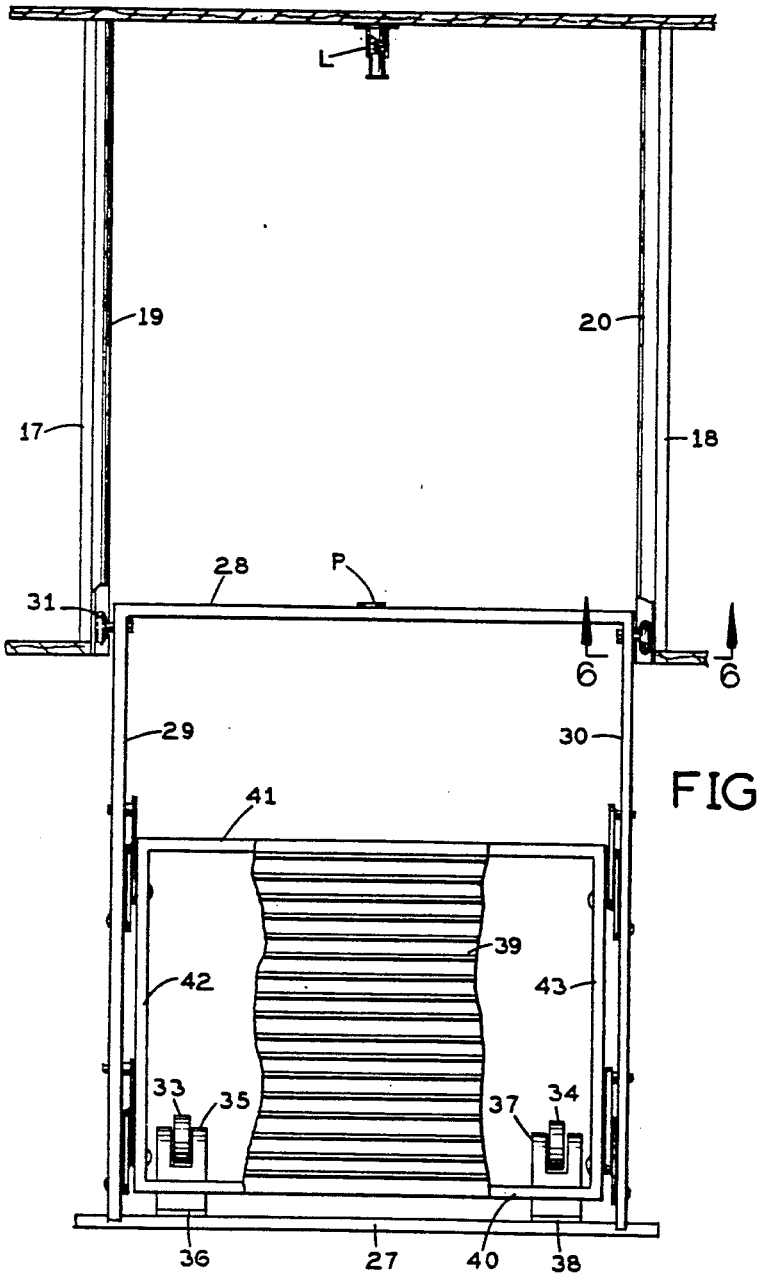
FIG. 5 is a top plan view of the step assembly as shown in FIG. 4.

The base B of the step assembly has a flat vertical front wall 27, a similar back wall 28 (FIG. 2), and opposite side walls 29 and 30 extending between the front and back walls and forming with them a rigid, open, rectangular structure, as best seen in FIG. 5. The front wall 27 carries a resilent pad **27*a* along its bottom edge. Near its back end the side wall 29 rotatably supports a roller 31, which is rollingly received in the guide channel 19. Near its back end the opposite side wall 30 of base B rotatably supports a roller 32, which is rollingly received in the guide channel 20. Rollers 31 and 32 constitute the second guide members in the present step assembly. The vertical dimension of base B is less than the vertical dimension of the interior space at the bottom of the cabinet between its internal bottom wall 13** and the floor F, so the base can be moved across the floor in and out of this space.

Figure 4:
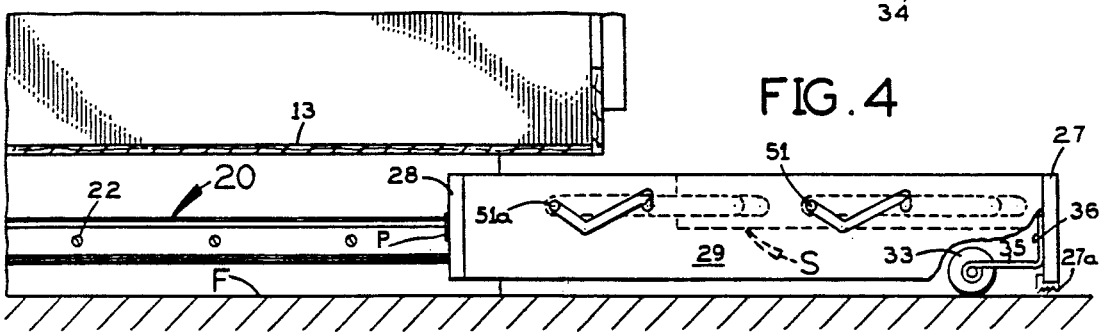
FIG. 4 is a side elevation of the step assembly pulled out in front of the cabinet but with the step lowered.

The front wall 27 of base B of the step assembly carries a pair of floor engaging rollers 33 and 34 (FIG. 5). As shown in FIGS. 4 and 5, roller 33 is rotatably mounted on the free end of a bifurcated, cantilevered, spring arm 35, the opposite end of which is bent up at 36 and fastened to the inside of the front wall 27 of the base close to its side wall 29. Similarly, roller 34 is rotatably supported by a bifurcated, cantilevered, spring arm 37 of the same configuration whose upwardly bent opposite end 38 is attached to the base front wall 27 close to its side wall 30. The spring arms 35 and 37 bias the rollers 33 and 34 downward against the floor F.

The step S in the step assembly has a grooved top platform 39 (FIG. 5) on top of rectangular frame having a front wall 40, a back wall 41, and opposite side walls 42 and 43. The sides 42 and 43 of step S are located inside and close to the corresponding sides 29 and 30 of the base B of the step assembly.

Figure 2:
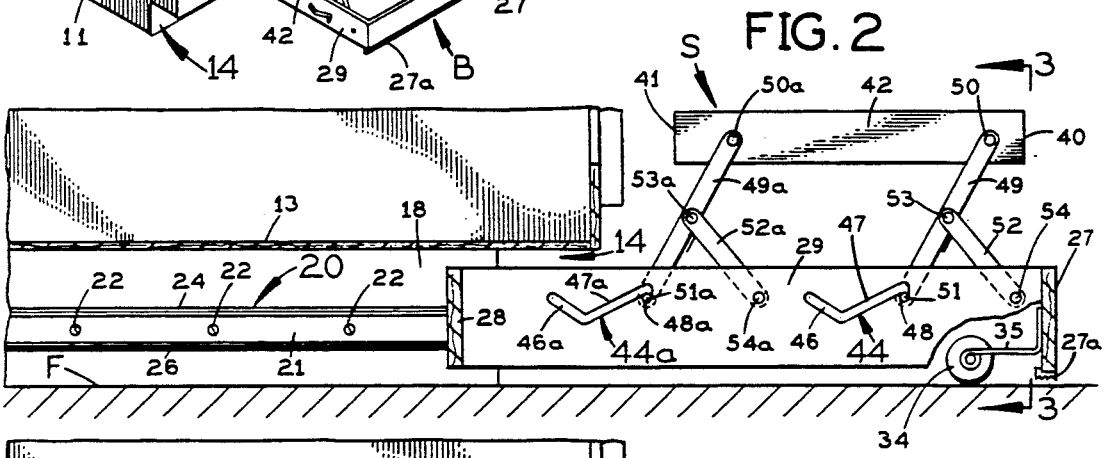
FIG. 2 is a vertical section showing the step assembly in its extended position in front of the floor cabinet.

As shown in FIG. 2, the side wall 29 of base B is formed with generally V-shaped front and rear slots 44 and 44*a*. The front slot 44 has a forwardly and downwardly inclined back segment 46, a front segment 47 which is inclined forward and upward from the front lower end of segment 46, and a downwardly offset notch 48 at the front upper end of front segment 47. The rear slot 44*a* is identical to the front slot, and corresponding elements of the rear slot have the same reference numerals, with an "a" suffix added, as the elements of the front slot.

On this side of the step assembly toward the front, a rigid, straight, elongated, first linkage arm 49 has its upper end pivotally connected at 50 to the side wall 42 of step S a short distance behind its front wall 40. A cross pin 51 on the lower end of linkage arm 49 is slidably received in the front slot 44 in side wall 29 of the base. A rigid, shorter, second linkage arm 52 at one end has a pivotal connection 53 to linkage arm 49 about midway along its length and at its opposite end has a pivotal connection 54 to the inside of the base side wall 29 a short distance behind its front wall 27.

On this same side of the step assembly toward the back, an identical pair of linkage arms 49*a* and 52*a* act between the base B and step S in the same manner. Corresponding elements of these linkage arms have the same reference numerals, with "a"suffixes added, as the linkage arms near the front.

As shown in FIG. 2, when the step S is raised and pulled forward, the cross pins 51 and 51*a* on the lower ends of linkage arms 49 and 49*a* are seated in the downwardly-offset notches 48 and 48*a* at the front ends of the respective slots 44 and 44*a*. This is a stable position of the linkages in which a weight on the step S, such as that of a person stepping on it, tends to maintain the linkage arms in this position.

To lower the step S into the base B, the user lifts the step enough to raise the cross pins 51 and 51*a* on the lower ends of linkage arms 49 and 49*a* out of the downwardly offset notches 48 and 48*a* at the front ends of slots 44 and 44*a*. Then, these cross pins can be slid back along these slots to the fully retracted position shown in phantom in FIG. 4. The short linkage arms 52 and 52*a* are aligned with the longer linkage arms 49 and 49*a* when the cross pins 51 and 51*a* on linkage arms 49 and 49*a* reach the back ends of slots 44 and 44*a*. In this position of the linkage arms, the step S is fully retracted down into the base B and the top face of the step is substantially flush with the top edges of the base. The vertical dimension of step S is substantially less than the vertical dimension of base B.

Identical front and rear linkages act between the base B and the step S at the opposite side of the step assembly.

FIGS. 8–10 show a second embodiment which differs from the ebodiment of FIGS. 1–7 in that the guide rails are mounted inside a rectangular box-like enclosure 100 (FIG. 8) having flat top and bottom walls 101 an 102, opposite side walls 103 and 104, a back wall 105, and front flanges 106 and 107 extending laterally outward at right angles from the front ends of sides walls 103 and 104. The enclosure 100 fits in the interior space at the bottom of the floor cabinet directly above the floor. The back wall 105 of the enclosure is attached by screws 108 to a back wall 109 of the floor cabinet, and the front flanges 106 and 107 of the enclosure are attached by screws 110 to front wall segments 111 and 112 of the floor cabinet at the back of the foot space 14 in FIG. 1.

As shown in FIG. 10, the guide rail 120 is welded or otherwise rigidly attached to the inside of the enclosure side wall 104. The opposite side rail 119 is similarly attached to the opposite side wall 103 of enclosure 100.

The rest of the assembly is identical to the embodiment of FIGS. 1–7, and the detailed description need not be repeated. Elements in FIG. 9 which correspond to the elements in FIGS. 1–7 have the same reference numerals plus 100.

The advantage of the embodiment of FIGS. 8–10 is that it is a complete and unitary assembly of all of the elements of the extensible and retractable step assembly.

The touch latch L and plate P shown in FIGS. 5 and 9 hold the step shut when it is closed and enable it to be opened by a touch on the step. The tip of the spring-biased latch L is a magnet which holds the step shut, but the latch will easily release the plate P when the step is touched.

I claim:

1. An extensible and retractable step assembly for a cabinet standing on a floor and having a hollow interior space directly above the floor, said step assembly comprising:

a base shaped and dimensioned to be received in said hollow interior space of the cabinet, floor-engaging rollers on said base;

first guide means positionable in said hollow interior space of the cabinet;

second guide means on said base having antifriction engagement with said first guide means to guide said base between a retracted position within said hollow interior space of the cabinet and an extend position in front of the cabinet;

a step carried by said base;

and linkage means acting between said base and said step and permitting said step to be selectively adjusted between a retracted lowered position on said base and an extended positioned raised up from said base when said base is in its extended position in front of the cabinet;

said base being a rectangular structure having a front wall, a back wall spaced behind said front wall, and opposite side walls extending between and interconnecting said front and back walls, said base being open between said front, back and opposite side walls;

said step fitting between said front, back and opposite side walls of the base;

and said linkage means being mechanical pivoted linkages on each of said opposite side walls of the base having a first position holding said step in its retracted lowered position and a stable second position holding said step in its extended position raised up from the base;

said pivoted linkages on each of said opposite side walls of the base in said first and second positions thereof being spaced above and out of contact with the floor;

and said pivoted linkages on each of said opposite side walls of the base comprising a first linkage located toward the front of said base and having respective pivotal connections to said side wall of the base and said step, and a second pivoted linkage spaced behind said first lingage and having respective pivotal connections to said side wall of the base and said step.

2. An extensible and retractable step assembly for a cabinet standing on a floor and having a hollow interior space directly above the floor, said step assembly comprising:

a base shaped and dimensioned to be received in said hollow interior space of the cabinet, said base being a rectangular structure having a front wall, a back wall spaced behind said front wall, and opposite side walls extending between and interconnecting said front and back walls, said base being open between said front, back and opposite side walls, floor engaging rollers on said base;

first guide means positionable in said hollow interior space of the cabinet;

second guide means on said base having anti-friction engagement with said first guide means to guide said base between a retracted position within said hollow interior space of the cabinet and an extended position in front of the cabinet;

a step carried by said base and fitting between said front, back and opposite side walls of the base;

and linkage means acting between said base and said step and permitting said step to be selectively adjusted between a retracted lowered position on said base and an extended positioned raised up from said base when said base is in its extended position in front of the cabinet, said linkage means being mechanical pivoted linkages having a first position holding said step in its retracted lowered position and a stable second position holding said step in its extended position raised up from the base;

each of said walls of the base having slots therein which are elongated lengthwise of said side wall;

and each of said pivoted linkages comprising an elongated first linkage arm having opposite first and second ends, said first linkage arm at its first end being pivoted to said step and at its second end being slidable along said slot, and a shorter second linkage arm which at one end is pivoted to said first arm between said first and second ends thereof and at its opposite end is pivoted to the respective side wall of the base in front of the respective slot.

3. A step assembly according to claim 2 wherein said floor-engaging rollers are located closely behind said front wall of the base.

4. An extensible and retractable step assembly for a cabinet standing on a floor and having a hollow interior space directly above the floor, said step assembly comprising:

a base having a vertical extent less than the vertical extent of said hollow interior space of the cabinet directly above the floor and shaped and dimensioned to be received in said hollow interior space of the cabinet, said base being a rectangular structure having a front wall, a back wall spaced behind said front wall, and opposite side walls extending between and interconnecting said front and back walls, said base being open at the top between said front, back and opposite side walls;

first guide means positionable in said hollow interior space of the cabinet on opposite side of said base;

second guide means on said base having anti-friction engagement with said first guide means to guide said base between a retracted position within said hollow interior space of the cabinet and an extended position in front of the cabinet;

a step carried by said base and shaped and dimensioned to be received in said open top of the base substantially completely within said vertical extent of the base, said step fitting between said front, back and opposite side walls of the base;

and linkage means acting between said base and said step and permitting said step to be selectively adjusted through said open top of the base between a retracted lowered position within the base and an extended position raised up from the base when said base is in its extended position in front of the cabinet, said linkage means being mechanical pivoted linkages having a first position holding said step in its retracted lowered position and a stable second position holding said step in its extended position raised up from the base;

each of said side walls of the base having slots therein which are elongate lengthwise of said side wall;

and each of said pivoted linkages comprising an elongated first linkage arm having opposite first and second ends, said first linkage arm at its first end being pivoted to said step and at its second end being slidable along said slot, and a shorter second linkage arm which at one end is pivoted to said first arm between said first and second ends thereof and at its opposite end is pivoted to the respective side wall of the base in front of the respective slot.

5. A step assembly according to claim 4 wherein:

said first guide means comprises elongated guide rails outside said opposite side walls of the base;

and said second guide means comprises guide rollers rotatably mounted on said opposite side walls of the base and rollingly received in said guide rails.

6. A step assembly according to claim 4 and further comprising floor-engaging rollers on said base closely behind said front wall of the base and spring-biased downward.

* * * * *

UNITED STATES PATENT AND TRADEMARK OFFICE

CERTIFICATE OF CORRECTION

PATENT NO. : 5,005,667

DATED : April 9, 1991

INVENTOR(S) : Face et al

It is certified that error appears in the above-identified patent and that said Letters Patent is hereby corrected as shown below:

The Drawing Sheet, consisting of FIGS. 8, 9 and 10, should be added as shown on the attached page.

Signed and Sealed this

Twenty-fifth Day of August, 1992

*Attest:*

DOUGLAS B. COMER

*Attesting Officer*

*Acting Commissioner of Patents and Trademarks*

FIG. 8
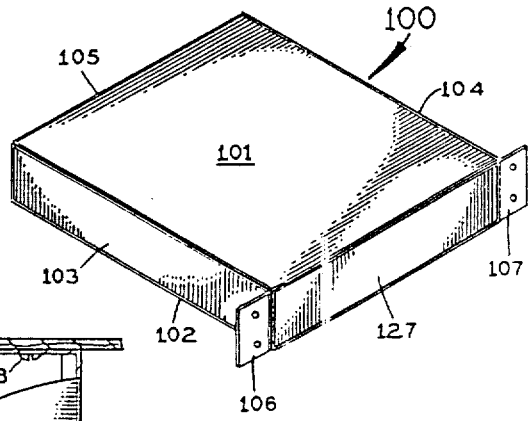
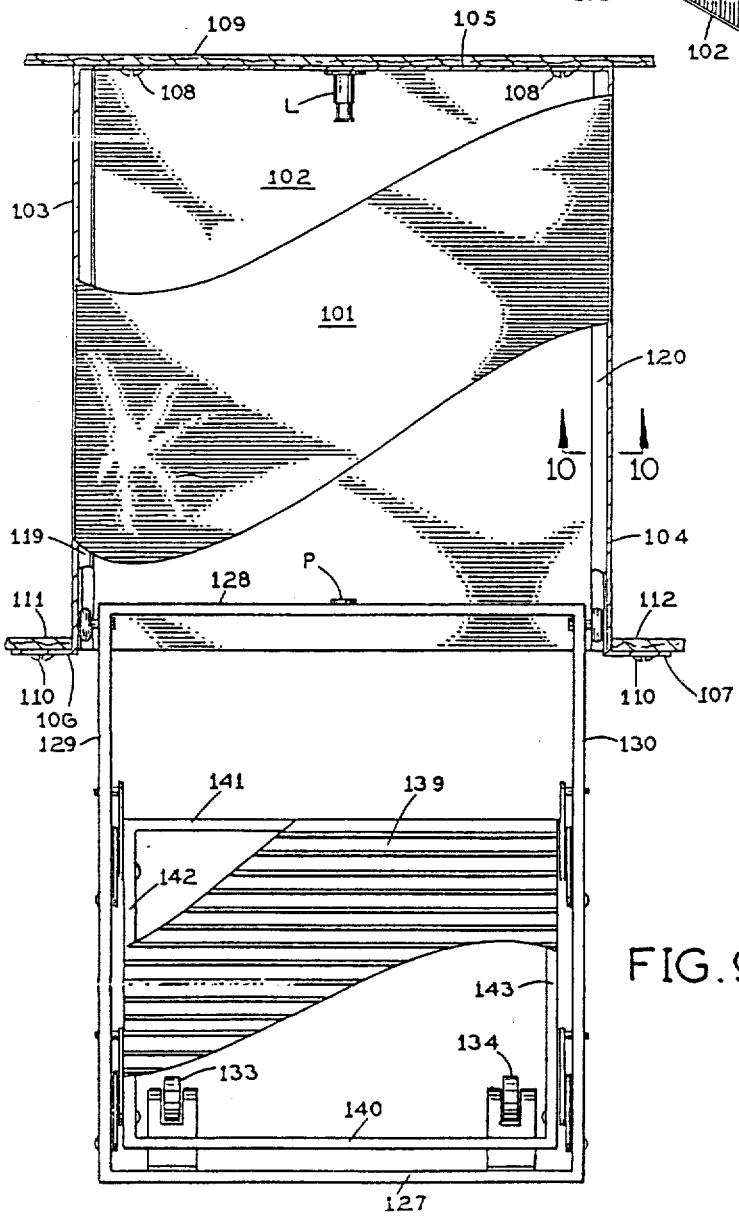
FIG. 9
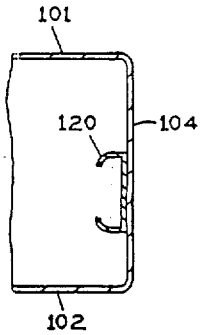
FIG. 10

UNITED STATES PATENT AND TRADEMARK OFFICE

CERTIFICATE OF CORRECTION

PATENT NO. : 5,005,667

DATED : Apr. 9, 1991

INVENTOR(S) : Eddy Anderson

It is certified that error appears in the above-identified patent and that said Letters Patent is hereby corrected as shown below:

The Drawing Sheet, consisting of FIGS. 8, 9 and 10, should be added as shown on the attached page.

This certificate supersedes Certificate of Correction issued August 25, 1992.

Signed and Sealed this

Third Day of November, 1992

*Attest:*

DOUGLAS B. COMER

*Attesting Officer*

*Acting Commissioner of Patents and Trademarks*

FIG. 8
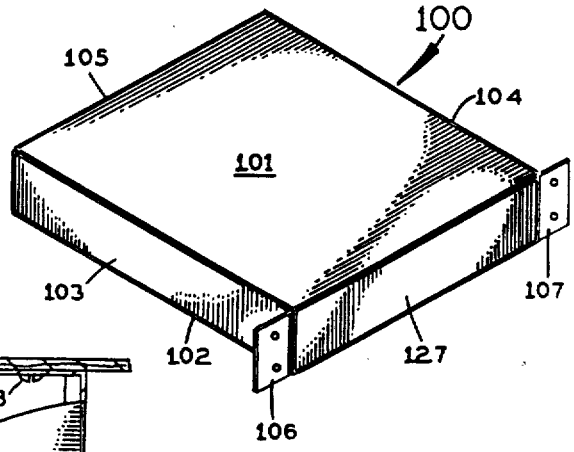
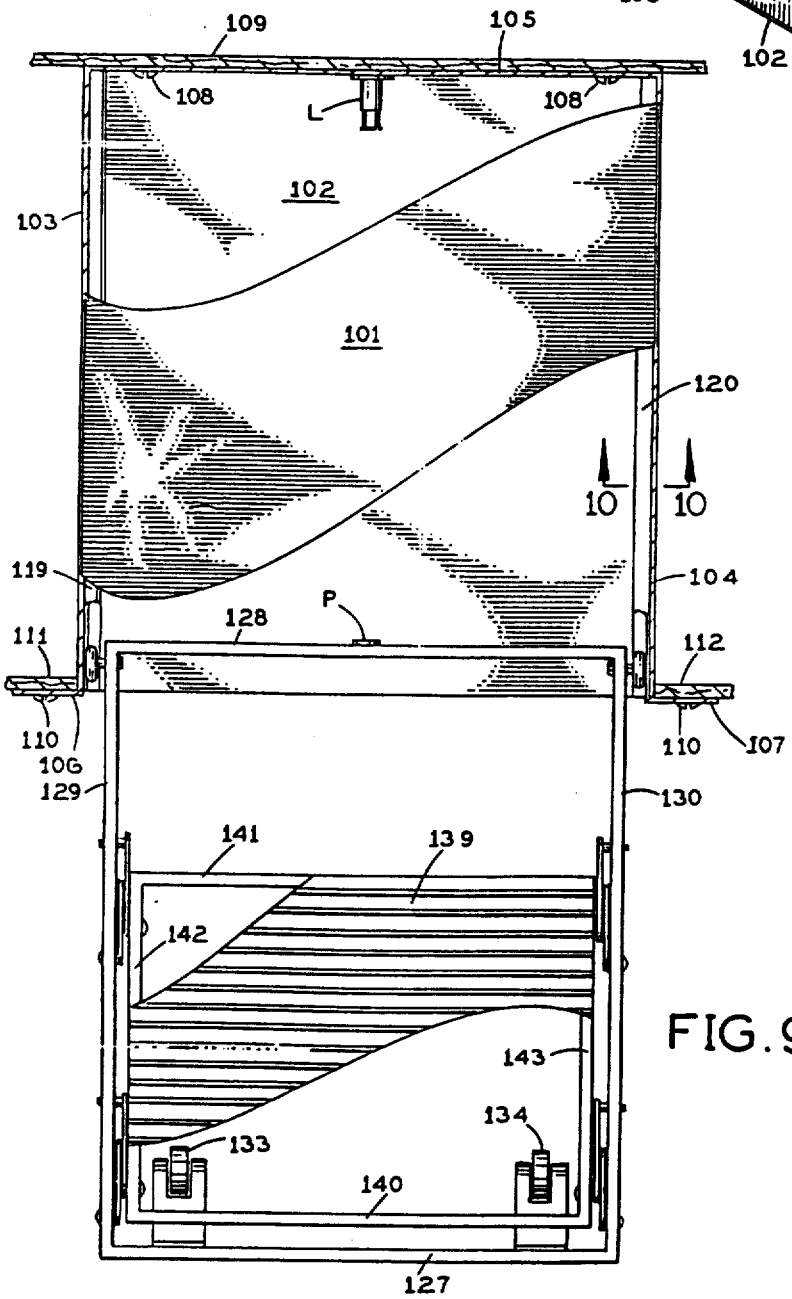
FIG. 9
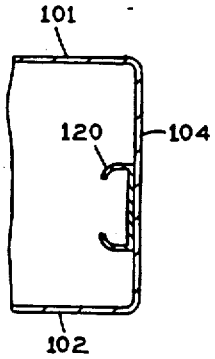
FIG. 10